US005593037A

United States Patent [19]

Ohayon

[11] Patent Number: 5,593,037

[45] Date of Patent: Jan. 14, 1997

[54] STACKABLE BINS

[76] Inventor: Abraham Ohayon, 1345 E. 38 St., Brooklyn, N.Y. 11234

[21] Appl. No.: 522,601

[22] Filed: Sep. 1, 1995

[51] Int. Cl.[6] ..... B65D 1/24; B65D 1/34; B65D 1/36; B65D 21/032

[52] U.S. Cl. ..... 206/509; 206/506; 206/561; 220/555; 220/675

[58] Field of Search ..... 206/509, 499, 206/561, 506, 557; 220/555, 553, 608, 669, 675

[56] References Cited

U.S. PATENT DOCUMENTS

| | | | |
|---|---|---|---|
| D. 197,311 | 1/1964 | Spaak et al. | 206/509 |
| 2,974,819 | 3/1961 | Melville | 220/555 |
| 3,002,650 | 10/1961 | Lovell . | |
| 3,107,131 | 10/1963 | Lightburn . | |
| 3,362,576 | 1/1968 | Beesley et al. . | |
| 3,392,874 | 7/1968 | Peebles | 206/509 X |
| 3,403,814 | 10/1968 | Asenbauer . | |
| 3,405,810 | 10/1968 | Rogus | 206/509 X |
| 3,976,193 | 8/1976 | Dogliotti | 220/555 X |
| 4,053,098 | 10/1977 | Baptist . | |
| 4,151,948 | 5/1979 | De La Fuente, Jr. . | |
| 4,176,747 | 12/1979 | Aho . | |
| 4,343,400 | 8/1982 | Faucillon | 220/555 X |
| 4,529,088 | 7/1985 | Quong . | |
| 4,660,725 | 4/1987 | Fishman et al. . | |
| 4,760,921 | 8/1988 | Licari | 206/509 X |
| 4,911,303 | 3/1990 | Andersson . | |
| 4,932,532 | 6/1990 | Apps . | |

FOREIGN PATENT DOCUMENTS

| | | | |
|---|---|---|---|
| 649452 | 10/1962 | Canada | 206/515 |

*Primary Examiner*—Allan N. Shoap
*Assistant Examiner*—Niki M. Kopsidas
*Attorney, Agent, or Firm*—Frishauf, Holtz, Goodman, Langer & Chick

[57] ABSTRACT

A stackable bin includes two spaced apart side walls, and a rear wall connecting rear edges of the side walls together. The side walls and rear wall are slightly inclined inwardly with respect to a vertical plane. A bottom wall is connected to lower portions of the side walls and rear wall and a central partition wall is connected with the bottom wall and rear wall to define first and second compartments open at front ends thereof. A channel extends parallel to and in alignment with the partition wall, and is formed at an underside of the bottom wall, for receiving an upper edge of a partition wall of a another stackable bin, for a supporting stackable arrangement therewith. Vertically oriented ribs are provided on outer surfaces of the side walls, for further supporting the stackable bin on the upper edges of side walls of the other stackable bin, and for increasing structural rigidity of the side walls. An elongated post is formed at the front edge of the partition wall and extends above the upper edge of the partition wall so as to define a post extension, and a recess is formed at a lower end of the elongated post for receiving the post extension of another stackable bin, thereby preventing forward sliding movement of the stacked bins relative to each other.

6 Claims, 5 Drawing Sheets

STACKABLE BINS

BACKGROUND OF THE INVENTION

The present invention relates generally to stackable bins, and more particularly, is directed to stackable bins dimensioned to hold consumer articles, such as shoes.

Stackable bins for holding articles are well known. In order to prevent relative movement between the bins while enabling a stacking relation, the lower periphery of each bin is typically provided with a horizontally oriented shoulder or wall that seats on an upper peripheral edge or shoulder of another such bin. However, in order to provide such shoulders, additional material is typically added about the periphery of the bin and/or the side walls of the bin are formed in a complex shape. In either case, the walls must generally be made thicker in large portions thereof. This is disadvantageous from a molding standpoint, since it not only requires additional material, but also presents problems such as the time for hardening of the material, warping of the material, and the like, as well as requiring the formation of complex molds.

Further, the aforementioned stacking arrangement presents problems in that the stackable bins can easily become disengaged from each other. This is because it is difficult, by means of the aforementioned shoulders, to maintain the stackable bins in the stacked arrangement. That is, a slight force typically can easily knock one stackable bin off of another.

SUMMARY OF THE INVENTION

It is an object of the present invention to provide a stackable bin that avoids the problems with the prior art.

Another object of the present invention is to provide a stackable bin having reinforcing ribs that perform a two-fold function of reinforcing the walls while also supporting the bin in a stacked arrangement.

It is another object of the present invention to provide a stackable bin that provides a reliable interlocking arrangement of the bins in the stacked configuration thereof.

A further object of the present invention is to provide a stackable bin having a partition wall that has a four-fold function of 1) supporting the bins in a stacked relation, 2) dividing each bin into two compartments, 3) increasing the structural integrity of each bin, and 4) locking the bins in a stacked relation.

A still further object of the present invention is to provide a stackable bin having a center recess at the front of the partition wall for receiving a center post of a next lower stacked bin to prevent forward sliding movement of the bin relative to the next lower bin.

A yet further object of the present invention is to provide a stackable bin that can be easily molded in a single piece.

In accordance with an aspect of the present invention, a stackable bin includes two spaced apart side walls, each having a front edge, a rear edge, an upper edge and a lower edge; a rear wall having opposite side edges connecting the rear edges of the side walls together, and said rear wall further having an upper edge and a lower edge; the side walls and the rear wall being slightly inclined inwardly with respect to a vertical plane from the upper edge to the lower edge thereof such that lower edges of the side walls and a rear wall of a second stackable bin fit within the upper edges of the side walls and the rear wall to form a supporting stackable arrangement therewith; a bottom wall connected to lower portions of the side walls and the rear wall; a partition wall extending generally parallel to the side walls and extending therebetween, the partition wall including an upper edge, a lower edge connected with the bottom wall, a front edge and a rear edge connected with the rear wall; a first compartment defined by one side wall, the rear wall, the bottom wall and the partition wall; a second compartment defined by the other side wall, the rear wall, the bottom wall and the partition wall; said first and second compartments being open at front ends thereof defined between front edges of the partition wall and respective side walls; and a channel extending parallel to and in alignment with the partition wall, and formed at an underside of the bottom wall, for receiving an upper edge of a partition wall of a third stackable bin to form a supporting stackable arrangement therewith.

Preferably, the partition wall is provided in a central portion of the stackable bin so as to form said first and second compartments to be of approximately the same size.

In addition, the partition wall includes a widened base portion, and the channel is further formed in the widened base portion.

Also, the lower edges of the side walls and the rear wall preferably extend to a position lower than the bottom wall.

Guides are preferably formed on opposite sides of the channel at the underside of the bottom wall, and extend to a same position lower than the bottom wall as the side walls and the rear wall.

Still further, vertically oriented ribs are preferably provided on outer surfaces of the side walls, for further supporting the stackable bin on the upper edges of side walls of the third stackable bin, and for increasing structural rigidity of the side walls. The vertically oriented ribs are provided adjacent to front and rear edges of the side walls, and in particular, there are a plurality of ribs in parallel spaced adjacent to the front edge of each side wall, and there are a plurality of ribs in parallel spaced adjacent to the rear edge of each side wall. Each rib is vertically oriented and has a lower edge at a position higher than the lower edge of the respective side wall.

Further, the bin includes means for preventing forward sliding movement of the stackable bin when stacked on the third stackable bin. Such means includes an elongated post formed at the front edge of the partition wall and extending above the upper edge of the partition wall so as to define a post extension, and a recess at a lower end of the elongated post for receiving a post extension of the third stackable bin to thereby prevent forward sliding movement of said second stackable bin in relation to said stackable bin. The elongated post has a width that tapers from a lower end thereof toward an upper end thereof.

The means for preventing forward sliding movement of the stackable bin further includes inwardly directed flanges at the front edges of the side walls for engaging lower surfaces of the second bin stacked thereon for preventing forward movement of the second bin with respect to said stackable bin.

These and other objects of the present invention are attained in accordance with the stackable bin configuration of the present invention which is described hereinafter.

DETAILED DESCRIPTION OF THE INVENTION

Figure 1:
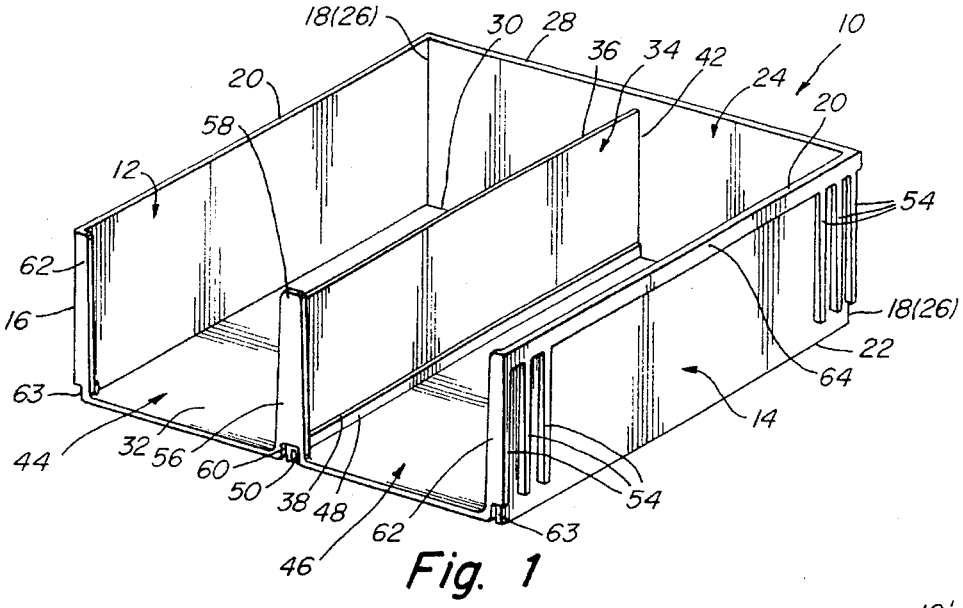
FIG. 1 is a perspective view of a stackable bin according to the present invention.

Referring to the drawings in detail, a stackable bin 10 according to the present invention is formed as a homogeneous, uniform and one piece plastic material. Since the present invention will be described with reference to bins that are stackable, the notation to be used hereinafter refers to a prime (') after a numeral to represent the top one of three stacked bins, a double prime (") after a numeral to represent the bottom one of the three stacked bins and a numeral by itself to represent the center bin of the three stacked bins and to describe the parts of a single bin in general.

Specifically, bin 10 includes two spaced apart side walls 12 and 14, each having a generally rectangular configuration with a front edge 16, a rear edge 18, an upper edge 20 and a lower edge 22. Although side walls 12 and 14 are described as preferably having a rectangular configuration, the present invention is not limited to this particular configuration.

Bin 10 further includes a rear wall 24 having opposite side edges 26 connecting rear edges 18 of side walls 12 and 14 together. Rear wall 24 further has an upper edge 28 and a lower edge 30. Rear wall 24 is also preferably formed in a rectangular configuration, although it is not so limited.

Figure 8:
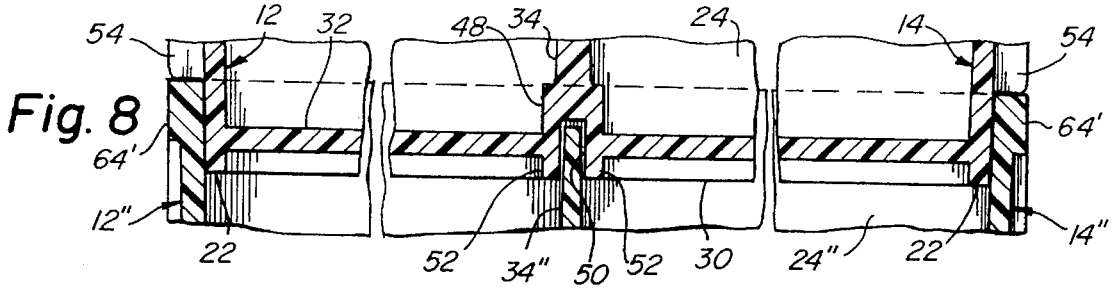
FIG. 8 is an enlarged fragmentary view, partly in section, of the stacked bins of FIG. 5, taken along line 8—8 thereof.
Figure 9:
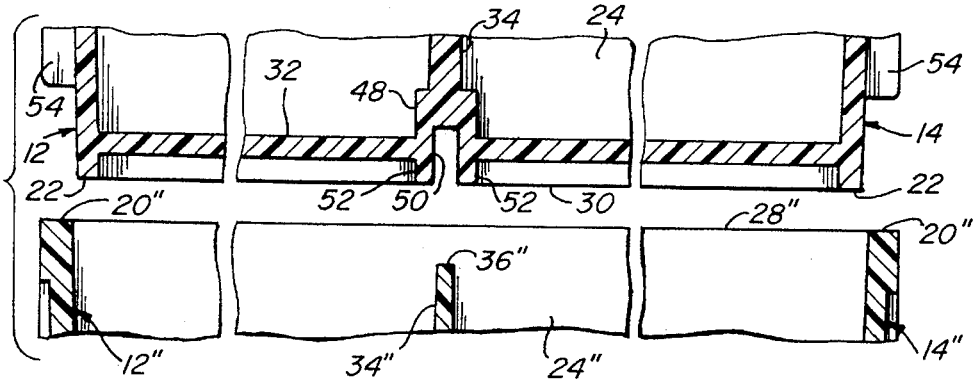
FIG. 9 is an exploded view of the interlocking parts of FIG. 8.
Figure 10:
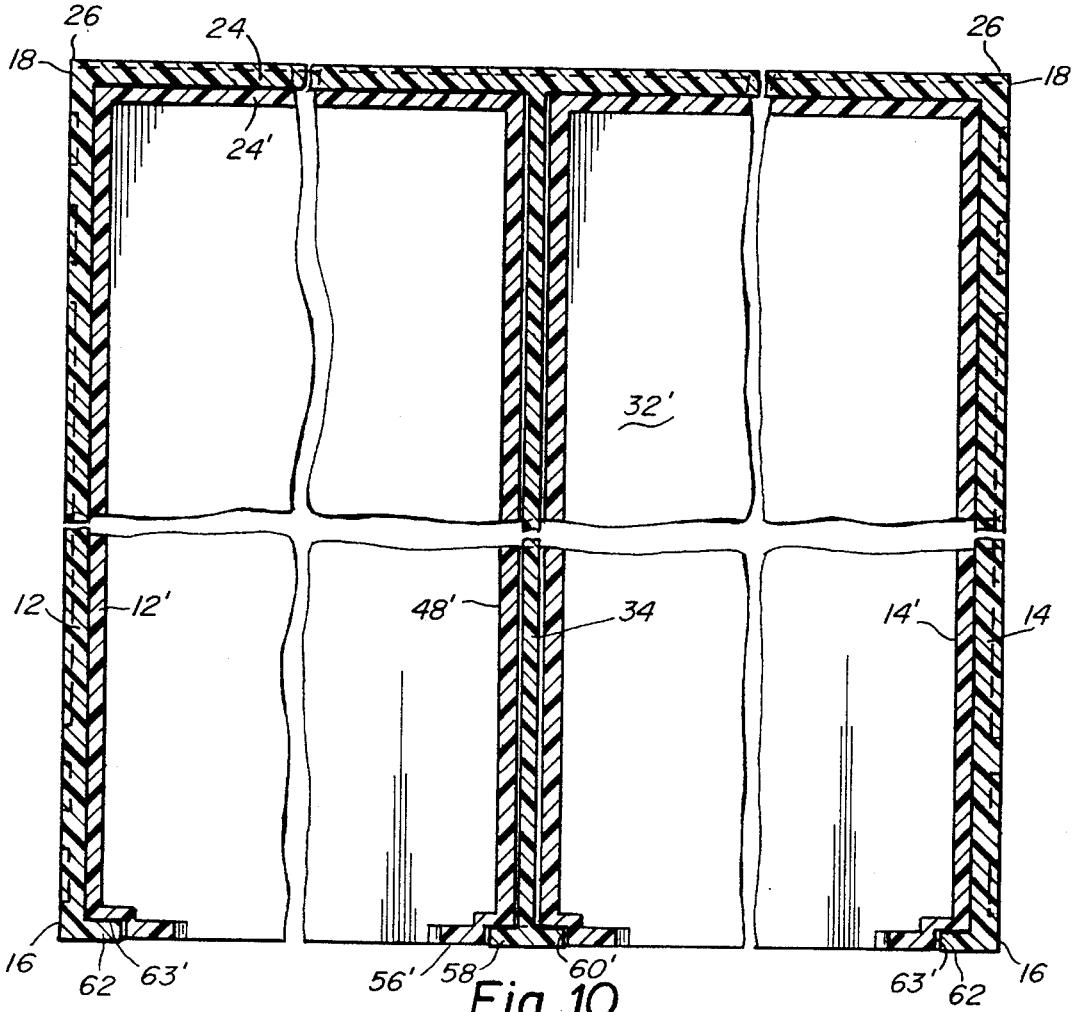
FIG. 10 is a sectional view of the bins of FIG. 2, taken along line 10—10 thereof.

In addition, bin 10 includes a bottom wall 32 that is connected to lower portions of side walls 12 and 14 and a lower portion of rear wall 24, to close off the bottom of bin 10. As best shown in FIGS. 8 and 9, side walls 12 and 14 and rear wall 24 extend slightly below bottom wall 32. That is, bottom wall 32 is connected at lower portions of side walls 12 and 14 and rear wall 24 at positions spaced slightly above lower edges 22 and 30 thereof.

Side walls 12 and 14 and rear wall 24 are each made of a generally thin sheet of plastic material having a substantially uniform thickness such that there is no need to provide any complex molds or very thick walls which would necessitate the use of a large amount of plastic material, as will become apparent from the discussion hereinafter.

Side walls 12 and 14 are slightly inclined or tapered inwardly with respect to a vertical plane from the upper edge 20 to the lower edge 22 thereof, such that lower edges 22 of side walls 12 and 14 of stackable bin 10 fit within upper edges 20" of side walls 12" and 14" of lowermost bin 10", as best shown in FIGS. 8 and 9 In like manner, rear wall 24 is slightly inclined or tapered inwardly with respect to a vertical plane from the upper edge 28 to the lower edge 30 thereof, such that lower edge 30 of rear wall 24 of stackable bin 10 fits within upper edge 28" of rear wall 24" of bin 10", as also shown in FIGS. 8 and 9. The inclination of walls 12, 14 and 24 permits bin 10 to be made as a single piece of plastic in a mold. That is, the inclination of walls 12, 14 and 24 permits the release of bin 10 from the mold while also providing the stacking arrangement as discussed hereinafter. For example, such taper or inclination can be about 1.5° with respect to the vertical.

A partition wall 34 extends generally parallel to and between side walls 12 and 14 at a central portion therebetween. Partition wall 34 is also a generally thin sheet of plastic material having a substantially uniform thickness, as with side walls 12 and 14 and rear wall 24. Partition wall 34 includes an upper edge 36, a lower edge 38 connected with bottom wall 32, a front edge 40 and a rear edge 42 connected with rear wall 24. As is clear from FIGS. 1 and 2, partition wall 34 is preferably of a lesser height than side walls 12 and 14 and rear wall 24.

With this arrangement, a first compartment 44 is defined by side wall 12, rear wall 24, bottom wall 32 and partition wall 34, while a second compartment 46 is defined by side wall 14, rear wall 24, bottom wall 32 and partition wall 34. As is clear from the drawings, and particularly FIG. 1 thereof, first and second compartments 44 and 46 are open at front ends thereof defined between front edges 16 and 40 of the respective side walls 12 and 14, and partition wall 34.

Next, the arrangement for stacking bins 10, 10' and 10", as well as increasing the structural rigidity and substantially preventing accidental escape of one bin from the stacked arrangement with another bin, will be discussed.

Figure 2:
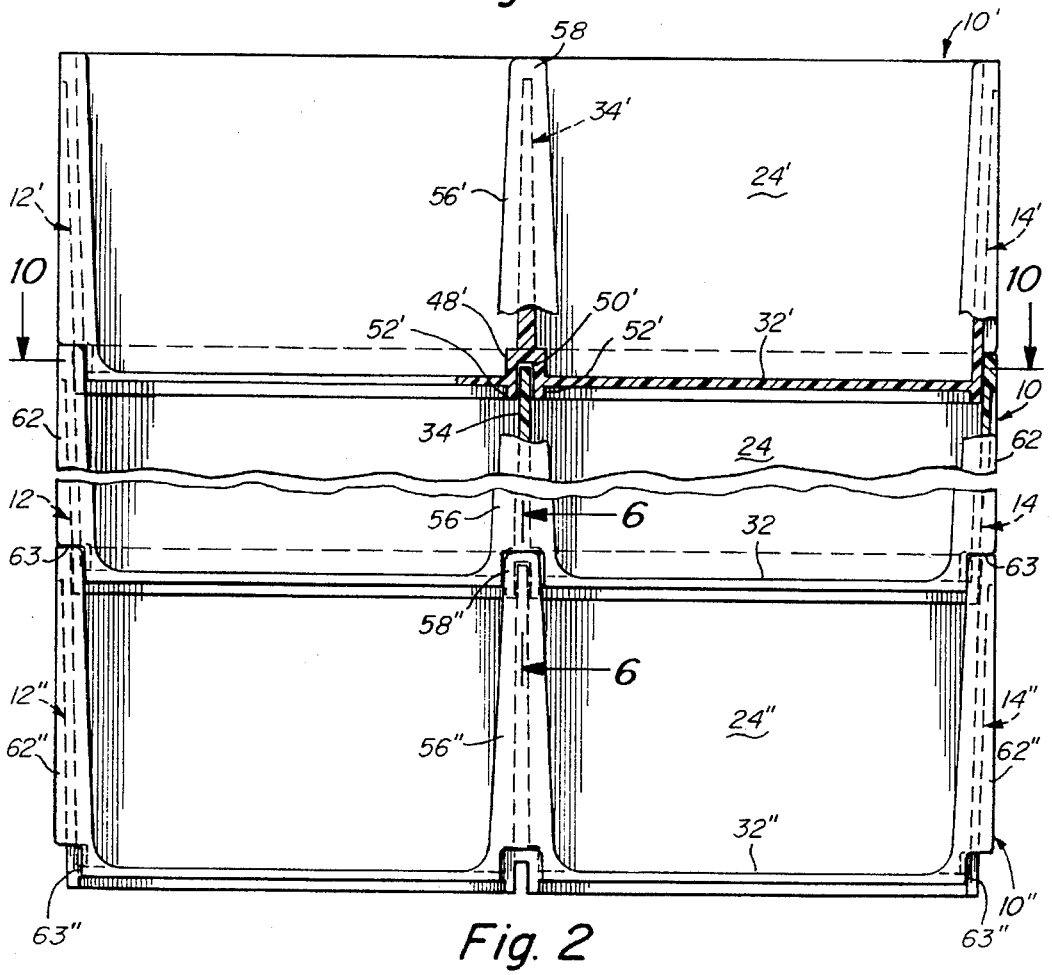
FIG. 2 is a front elevational view, partly in section, of a plurality of the stackable bins of FIG. 1, in stacked relation.
Figure 3:
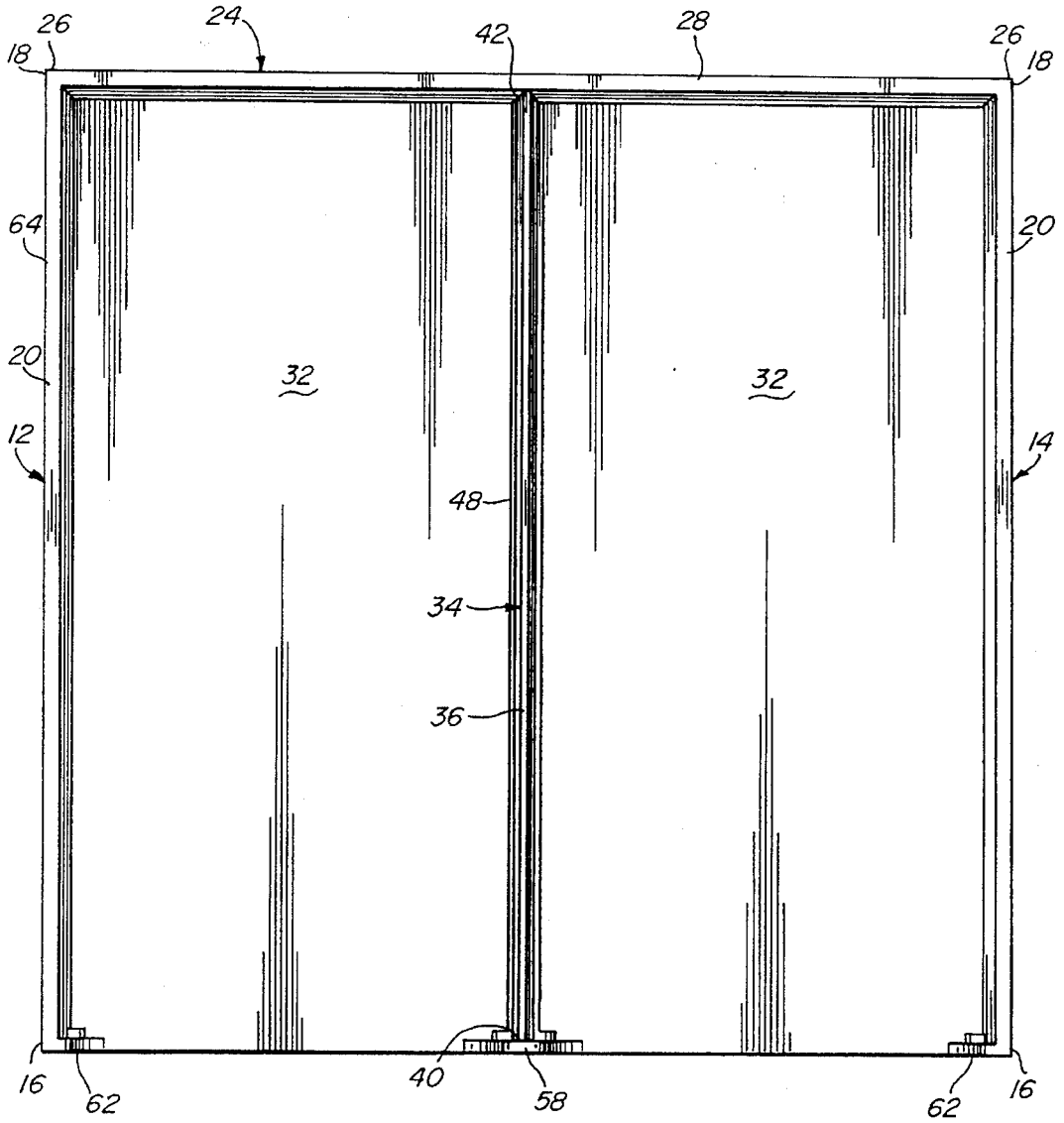
FIG. 3 is a top plan view of the stackable bin of FIG. 1.
Figure 4:
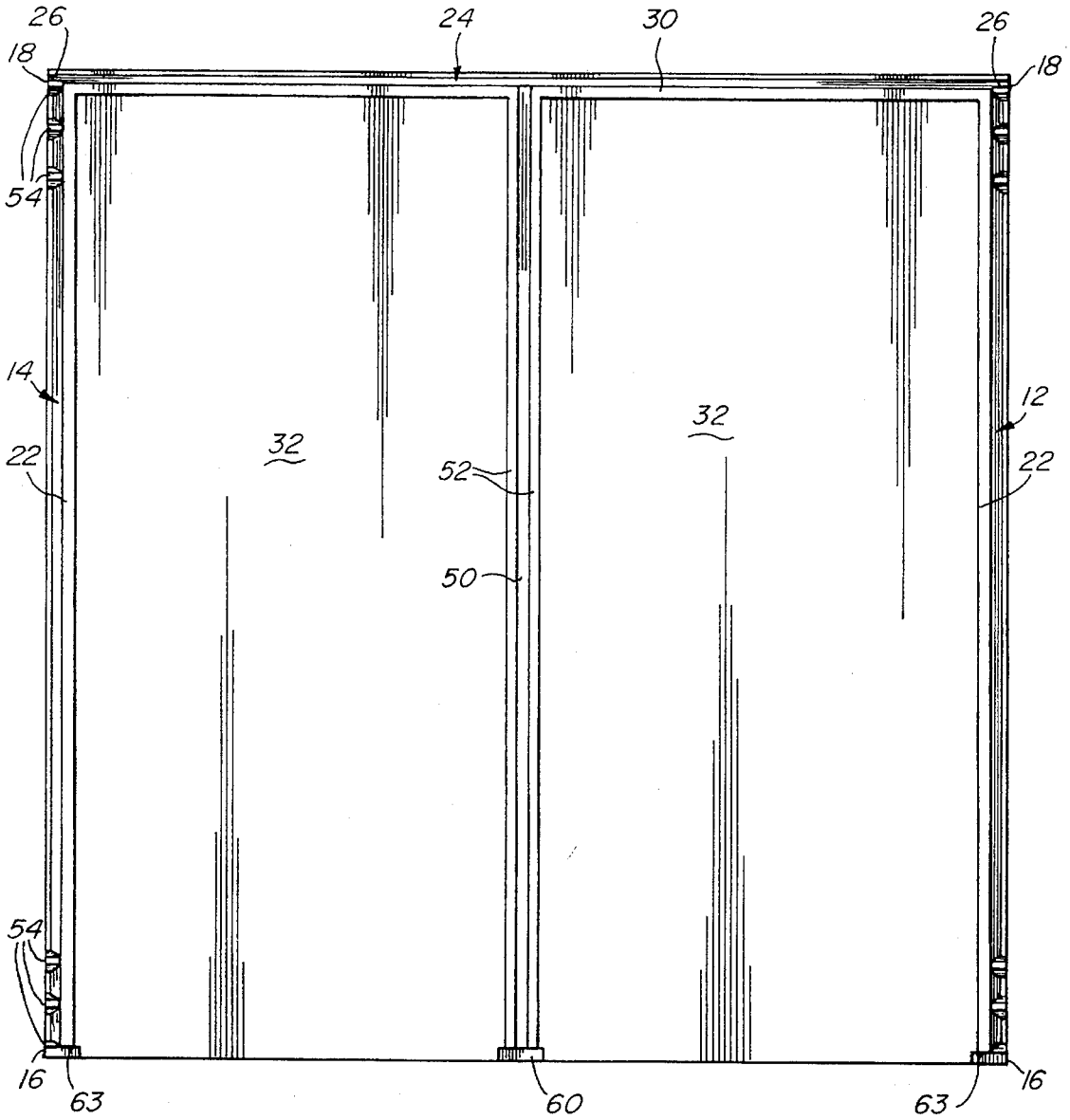
FIG. 4 is a bottom plan view of the stackable bin of FIG. 1.
Figure 5:
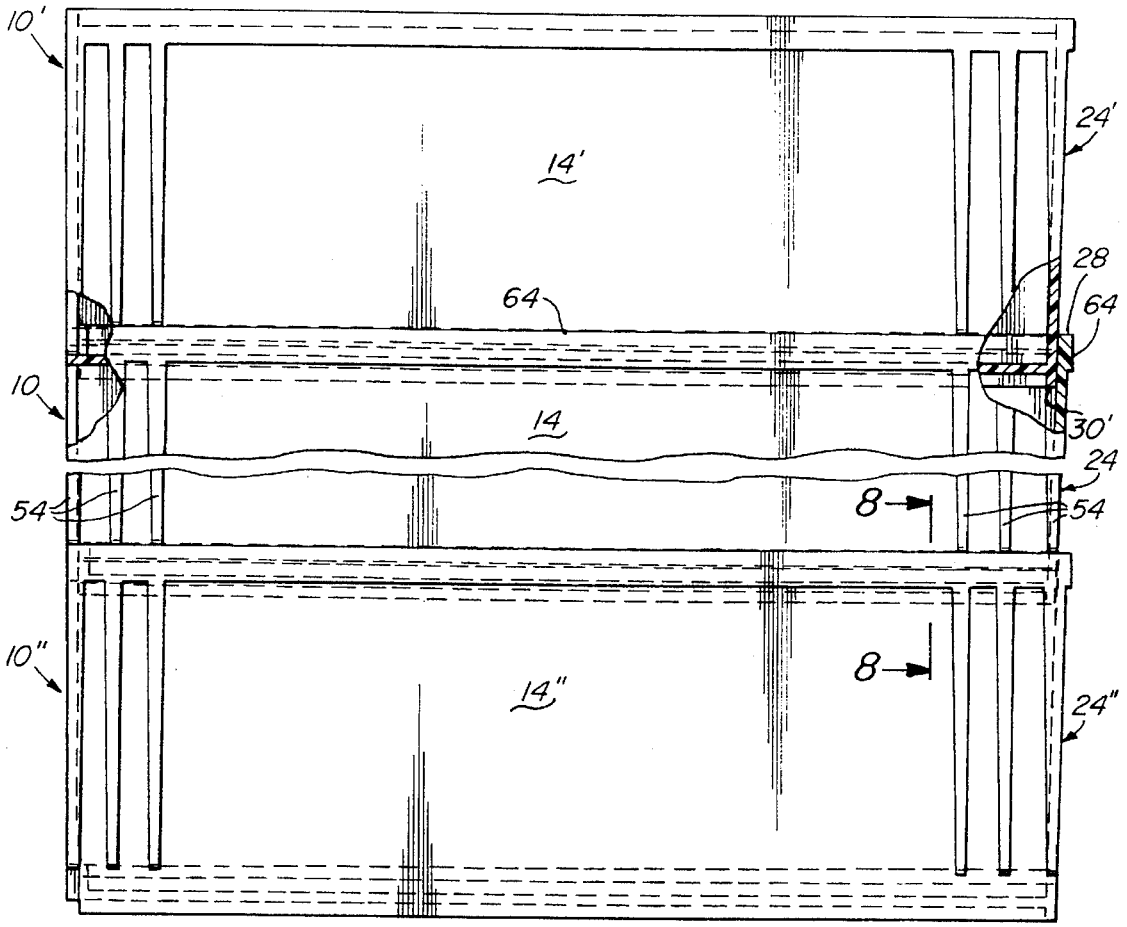
FIG. 5 is a side elevational view, partly in section, of the stacked bins of FIG. 2.
Figure 6:
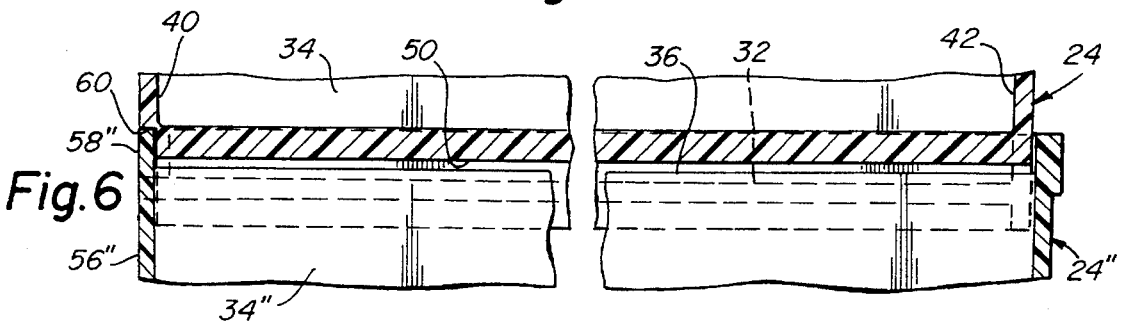
FIG. 6 is an enlarged fragmentary sectional view of the bins of FIG. 2, taken along line 6—6 thereof.
Figure 7:
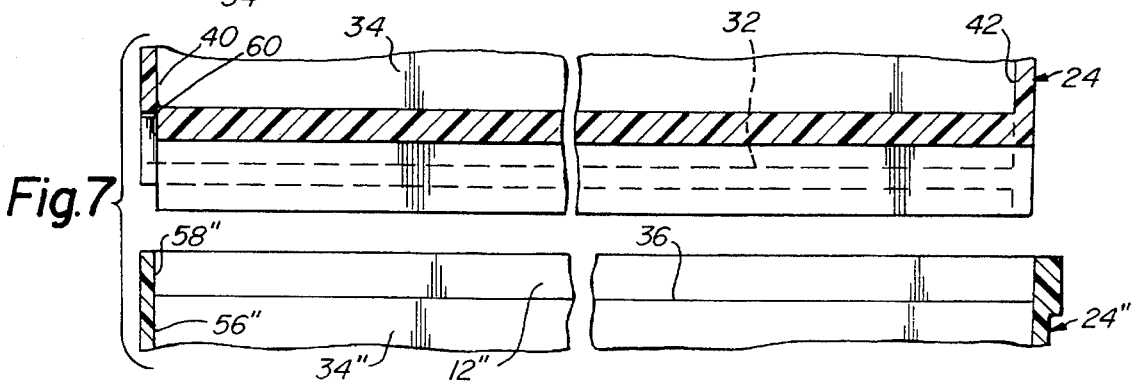
FIG. 7 is an exploded view of the interlocking parts of FIG. 6.

Specifically, partition wall 34 is provided with a widened base portion 48. A channel 50 extends parallel to and in alignment with partition wall 34, and is formed at an underside of bottom wall 32 for the entire length of bin 10, while also extending partially into base portion 48, as best shown in FIGS. 2, 8 and 9, for receiving upper edge 36" of the partition wall 34" of stackable bin 10", and thereby effectively providing a locking or interlocking arrangement. With such construction, a supporting stackable arrangement of bins 10, 10' and 10" is provided. At the same time, partition wall 34 provides support for another bin, and also functions to divide bin 10 into two compartments 44 and 46 while increasing the structural rigidity of bin 10. Therefore, partition wall 34 serves the four-fold functions of 1) supporting the bins in a stacked relation, 2) dividing each bin into two compartments, 3) increasing the structural integrity of each bin, and 4) locking the bins in a stacked relation.

In order to provide uniform support when bin 10 is placed on a flat surface, two parallel, spaced apart guides 52 are provided on the underside of bottom wall 32 on opposite sides of channel 50. Specifically, guides 52 extend the same distance below bottom wall 32 as do side walls 12 and 14 and rear wall 24. Thus, when bin 10 is placed on a flat surface, the lower edges of side walls 12 and 14, rear wall 24 and guides 52 will support bin 10.

As a further means of supporting bins 10, 10' and 10" on top of each other while further increasing the structural rigidity of side walls 12 and 14 without adding great amounts of material thereto, vertically oriented ribs 54 are provided on outer surfaces of side walls 12 and 14 adjacent the front and rear edges 16 and 18 thereof. Although three spaced ribs 54 are shown provided at each end of each side wall 12 and 14, the present invention is not limited to this number or this positioning. As shown, ribs 54 do not extend down to lower edges 22 of side walls 12 and 14. Thus, as shown in FIGS. 8 and 9, the lower edges of ribs 54 function to support stackable bin 10 on upper edges 20" of side walls 12" and 14" of stackable bin 10", while also increasing the structural rigidity of side walls 12 and 14.

Bin 10 further includes means for preventing forward sliding movement of stackable bin 10 when stacked on stackable bin 10". This is accomplished in two ways. First, an elongated post or plate 56 is formed at front edge 40 of partition wall 34 and extends to a height above upper edge 36 of partition wall 34 so as to define a post extension 58 thereat. Post extension 58 preferably extends to the same height as side walls 12 and 14 and rear wall 24. Preferably, elongated post 56 tapers slightly from its lower edge to post extension 58 thereof.

A shallow recess 60 is formed at the lower end of elongated post 56 for receiving the post extension 58" of bin 10", thereby providing a flush arrangement at the front of the bins, and thereby preventing forward sliding movement of bin 10 relative to bin 10". Although post extension 58 and recess 60 are shown in the drawings as being rectangular in configuration, the present invention is now limited to this particular configuration or shape.

In addition, inwardly directed flanges 62 are formed at the front edges 16 of side walls 12 and 14, along the entire height thereof. When the lower edges 22' of side walls 12'and 14' of bin 10' fit with the upper edges 20 of side walls 12 and 14 of bin 10, the lower edges 22' are prevented from moving forward by flanges 62, thereby further aiding in preventing sliding movement of bin 10 relative to bin 10'.

Specifically, side walls 12 and 14, bottom wall 32 and the forwardmost ribs 54 are cut away at the lower front corners of bin 10 to provide recessed areas 63 that receive the upper edges of flanges 62" of bin 10", thereby providing a flush arrangement at the front of the bins.

In order to further increase the rigidity of bin 10, without adding a large amount of material, the upper portions of side walls 12 and 14 and rear wall 24 have an increased thickness so as to define an upper peripheral lip 64.

It will therefore be appreciated from the above that stackable bin 10 has reinforced walls, while not requiring an increase in the overall thickness of the walls. This is accomplished by means of reinforcing ribs that perform a two-fold function of reinforcing the walls and supporting the bin in a stacked arrangement.

Further, bin 10 includes a partition wall that has a four-fold function of 1) supporting the bins in a stacked relation, 2) dividing each bin into two compartments, 3) increasing the structural integrity of each bin, and 4) locking the bins in a stacked relation.

Still further, it will be appreciated that, because of the taper of the side walls, stackable bin 10 can be easily molded in a single piece, while ensuring that the bins fit within each other.

Having described a specific preferred embodiment of the invention with reference to the accompanying drawings, it will be appreciated that various modifications thereto can be effected by one of ordinary skill in the art without departing from the scope or spirit of the invention.

We claim:

1. A stackable bin comprising:

two spaced apart side walls, each having a front edge, a rear edge, an upper edge and a lower edge;

a rear wall having opposite side edges connecting said rear edges of said side walls together, and said rear wall further having an upper edge and a lower edge;

said side walls and said rear wall being slightly inclined inwardly with respect to a vertical plane from the upper edge to the lower edge thereof such that the lower edges of said side walls and a rear wall of a second said stackable bin fit within the upper edges of said side walls and said rear wall to form a supporting stackable arrangement therewith;

a bottom wall connected to lower portions of said side walls and said rear wall;

a partition wall extending generally parallel to said side walls and extending therebetween, said partition wall including an upper edge, a lower edge connected with said bottom wall, a front face and a rear face connected with said rear wall;

a first compartment defined by one said side wall, said rear wall, said bottom wall and said partition wall;

a second compartment defined by the other said side wall, said rear wall, said bottom wall and said partition wall;

said first and second compartments being open at front ends thereof defined between front edges of said partition wall and respective said side walls; and a channel extending parallel to and in alignment with said partition wall, and formed at an underside of said bottom wall, for receiving the upper edge of a partition wall of a third said stackable bin therein to form a supporting stackable arrangement therewith; and means for preventing forward sliding movement of said stackable bin when stacked on said third stackable bin, said means for preventing forward sliding movement of said stackable bin including:

an elongated post formed at the front face of said partition wall and extending from said bottom wall to a position above the upper edge of said partition wall so as to define a post extension, and a recess at a lower end of said elongated post for receiving a post extension of said third stackable bin to thereby prevent forward sliding movement of said stackable bin in relation to said third stackable bin.

2. A stackable bin according to claim 1, wherein said partition wall is provided in a central portion of said stackable bin so as to form said first and second compartments to be of approximately the same size.

3. A stackable bin according to claim 1, wherein said partition wall includes a widened base portion, and said channel is further formed in said widened base portion.

4. A stackable bin according to claim 1, wherein said elongated post has a width that tapers from a lower end thereof toward an upper end thereof.

5. A stackable bin according to claim 1, wherein said means for preventing forward sliding movement of said stackable bin further includes inwardly directed flanges at the front edges of said side walls for preventing forward movement of said second bin with respect to said stackable bin.

6. A stackable bin comprising:

two spaced apart side walls, each having a front edge, a rear edge, an upper edge and a lower edge;

a rear wall having opposite side edges connecting said rear edges of said side walls together, and said rear wall further having an upper edge and a lower edge;

said side walls and said rear wall being slightly inclined inwardly with respect to a vertical plane from the upper edge to the lower edge thereof such that the lower edges of said side walls and a rear wall of a second said stackable bin fit within the upper edges of said side walls and said rear wall to form a supporting stackable arrangement therewith;

a bottom wall connected to lower portions of said side walls and said rear wall;

a partition wall extending generally parallel to said side walls and extending therebetween, said partition wall including an upper edge, a lower edge connected with said bottom wall, a front face and a rear face connected with said rear wall:

a first compartment defined by one said side wall, said rear wall, said bottom wall and said partition wall;

a second compartment defined by the other said side wall, said rear wall, said bottom wall and said partition wall;

said first and second compartments being open at front ends thereof defined between front edges of said partition wall and respective said side walls;

a channel extending parallel to and in alignment with said partition wall, and formed at an underside of said bottom wall, for receiving the upper edge of a partition wall of a third said stackable bin therein to form a supporting stackable arrangement therewith;

vertically oriented rib means, provided on outer surfaces of said side walls, for further supporting said stackable bin on the upper edges of side walls of said third stackable bin, and for increasing structural rigidity of said side walls; and means for preventing forward sliding movement of said stackable bin when stacked on said third stackable bin, said means for preventing forward sliding movement of said stackable bin including:

an elongated post formed at the front face of said partition wall and extending from said bottom wall to a position above the upper edge of said partition wall so as to define a post extension, and a recess at a lower end of said elongated post for receiving a post extension of said third stackable bin, to thereby prevent forward sliding movement of said stackable bin in relation to said third stackable bin.

* * * * *